United States Patent [19]

Dacal

[11] 4,069,415

[45] Jan. 17, 1978

[54] HIGH INTENSITY DISCHARGE LAMP FOR USE IN EXPLOSIVE ATMOSPHERES SUCH AS MINES

[75] Inventor: Perfecto Dacal, Beckley, W. Va.

[73] Assignee: Control Products Inc., Beckley, W. Va.

[21] Appl. No.: 757,637

[22] Filed: Jan. 7, 1977

[51] Int. Cl.[2] ..... F21L 15/06

[52] U.S. Cl. ..... 362/263; 362/267; 362/362

[58] Field of Search ..... 240/11.2 E, 11.3, 11.4 R, 240/18, 44.1, 41.55, 92, 102 R, 41.35 R, 54 R, 73 R

[56] References Cited

U.S. PATENT DOCUMENTS

| | | | |
|---|---|---|---|
| D 163,742 | 6/1951 | Bogaerts | 240/18 |
| 3,564,234 | 2/1971 | Phlieger, Jr. | 240/51.11 R |
| 3,626,424 | 12/1971 | Kahn | 240/54 R X |
| 4,021,660 | 5/1977 | Szpur | 240/41.55 |

FOREIGN PATENT DOCUMENTS

| | | | |
|---|---|---|---|
| 167,001 | 8/1921 | United Kingdom | 240/11.2 |

*Primary Examiner*—J D Miller
*Assistant Examiner*—Peter S. Wong
*Attorney, Agent, or Firm*—McCaleb, Lucas & Brugman

[57] ABSTRACT

Lamp having a rectangular bulb housing and a cage-like outer guard assembly therefor. The bulb housing is generally in the shape of a modified cube elongated in one direction. The housing has four substantially same size rectangular sidewalls extending between substantially square head and tail endwalls. One of the sidewalls is imperforate and serves as a mounting base. The other three sidewalls have windows of heavy, heat-resistant, transparent glass-like or ceramic material. The head endwall has a pair of glands including flanged, threaded bushings to seal electrical power conductors extending through it. The flanges of the bushing have wrench-engageable flats. The endwalls have a pair of axially aligned, screw-threaded openings of identical thread diameter and pitch. Screw-threaded head and tail cover members are threadedly engageable within these openings. A bulb socket member and a grounding lug are mounted on the inside surface of the head cover member, all being removable as a unit by unscrewing the head cover member. There is a central boss with wrench-engageable flats on the outside surface of the head cover member. A locking plate simultaneously engages flats on the gland bushings, and on the boss, to prevent loosening. A screw-threaded inspection plug in one of the sidewalls provides access to the grounding lug. The entire bulb housing is protected within a cage-like outer guard assembly. Different shaped reflector means between the bulb and housing direct the light through one or more selected side windows, in addition to an end window in the tail cover member.

8 Claims, 8 Drawing Figures

HIGH INTENSITY DISCHARGE LAMP FOR USE IN EXPLOSIVE ATMOSPHERES SUCH AS MINES

CROSS REFERENCES TO RELATED APPLICATIONS

Reference is made to the following co-pending applications:

Dacal U.S. design application Ser. No. 680,048, filed Apr. 26, 1976 on EXPLOSION PROOF FLUORESCENT LAMP FOR MINES OR THE LIKE.

Dacal U.S. design application Ser. No. 689,596, filed May 25, 1976 on FLUORESCENT LAMP FOR USE IN EXPLOSIVE ATMOSPHERES SUCH AS MINES.

Dacal U.S. application Ser. No. 704,061, filed July 9, 1976 on FLUORESCENT LAMP FOR USE IN EXPLOSIVE ATMOSPHERES SUCH AS MINES.

BACKGROUND OF THE INVENTION

This invention pertains to the field of electrical illuminating apparatus and particularly to such apparatus which is permissible under Mining Enforcement and Safety Administration (MESA) standards and regulations for use in explosive atmospheres such as coal mines.

Lighting in mines has always been relatively poor compared to working environments above ground where minimum illumination standards for various tasks have long been established.

The difficulty of providing adequate lighting in coal mines is aggravated by the low reflectivity of the black coal and associated minerals in the roof, floor, and side walls. Rock-dusting, where employed, provides a reflective white or light gray surface along established haulageways and heavy traffic areas such as underground maintenance shops, areas immediately adjacent the bottoms of hoisting shafts, and loading points along conveyors. These locations for the most part, are well illuminated with permanent lighting.

By contrast, rooms where coal is actively being mined are relatively poorly lighted. These rooms have not yet been rock-dusted and the freshly exposed black surfaces provide no practical reflectivity. Illumination is provided only by miners' cap lamps and one or more high intensity headlight-type lamps on each piece of mobile mining machinery. In the case of shuttle cars, which operate in both directions, there will be one or more headlights at each end. Even where such high intensity lamps are directed toward the face, or toward the direction of movement of the machine, lighting is far from uniform. The operator of a continuous mining machine, or loading machine, will have enough light brilliantly illuminating the mine face to keep the machine working efficiently, but the rear boom just behind the operator is in relative darkness making it difficult to see a person immediately behind or to the side. Inasmuch as these face-working machines have conveyor discharge booms which are tiltable up and down, and swingable from side to side, there have been numerous accidents involving persons unseen by the machine operators being struck by the discharge booms and pressed against another machine or one of the sidewalls.

MESA reports show that almost all serious and fatal accidents in working places occur while self-propelled equipment is operated in them.

Pursuant to authority under the Federal Coal Mine Health and Safety Act of 1969, the Secretary of the Interior has promulgated new illumination standards for underground coal mines which, among other things, specify that the entire area surrounding self-propelled mining equipment for a minimum distance of 5 feet be illuminated with a surface brightness of at least 0.06 footlamberts.

To provide this level of illumination, it is absolutely necessary that something more efficient than conventional incandescent lamps be used. As shown in applicant's above-identified co-pending patent applications, applicant has developed fluorescent lighting permissible for use in potentially explosive atmospheres such as coal mines, which can provide the high level illumination required by the new standards. However, even higher standards of illumination may be required in the future, and in more compact lamps.

High intensity discharge ("HID") lamps provide light levels and lumens per watt efficiencies greatly exceeding fluorescent lamps. For many years, virtually all of the HID lamps of commercial significance were mercury vapor lamps. They trace their history back to the Cooper-Hewitt lamp developed in 1901 by Peter Cooper Hewitt. Continuing research has developed the modern high pressure sodium lamp which is believed to be the most efficient lamp known among all light sources now commercially available. It provides up to 140 lumens per watt compared with 80 lumens per watt for fluorescent lamps, 50 lumens per watt for mercury vapor lamps, and 15 to 20 lumens per watt for incandescent lamps. The arc tube in the high pressure sodium lamp operates at such high temperatures (1300° Celsius, 2,372° Fahrenheit) that it must be made of something like translucent aluminum oxide. It would melt the high temperature glass, and even quartz, which are used in other types of lamps. This very high service temperature, and the extremely corrosive effects of hot sodium, have made it difficult to apply this lamp to use in underground mines having explosive atmospheres, even though the increased illumination would reduce accidents and personal injuries, and much of the electrical energy now used for lighting purposes would be conserved.

SUMMARY OF THE INVENTION

It is a general object of the present invention to provide a lamp permissible for use in explosive atmospheres such as coal mines which will provide the high illumination required to meet and exceed the new MESA standards, and in a more compact arrangement than is possible with a fluorescent lamp.

It is a specific object of the present invention to provide such a compact lighting assembly using a high intensity discharge lamp element and in particular a high pressure sodium vapor lamp unit.

An important feature of the invention is an assembly which provides substantial protection for the lamp by means of a strong housing and an outer cage-like guard assembly, yet enables the bulb, or the entire bulb and socket assembly, to be replaced quickly, on site, without taking the entire lamp assembly to a distant repair shop.

Another feature is the provision of a compact rectangular housing having a square cross-section in which the bulb is centrally located, enabling use of optional U-shaped or L-shaped reflectors for concentrating and directing light selectively through one or more windows in the four sidewalls of the housing.

BRIEF DESCRIPTION OF THE DRAWINGS

Other objects and advantages will be apparent from the following description taken in connection with the drawings in which.

Like parts are designated by like reference characters throughout the drawings.

DESCRIPTION OF THE PREFERRED EMBODIMENT

Figure 1:
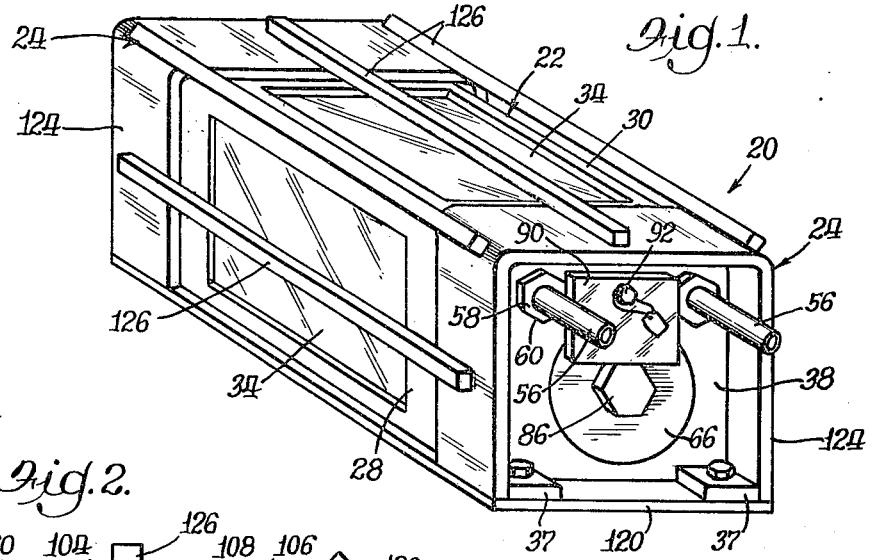
FIG. 1 is a perspective view of a high intensity discharge lamp illustrating a preferred form of the present invention.
Figure 2:
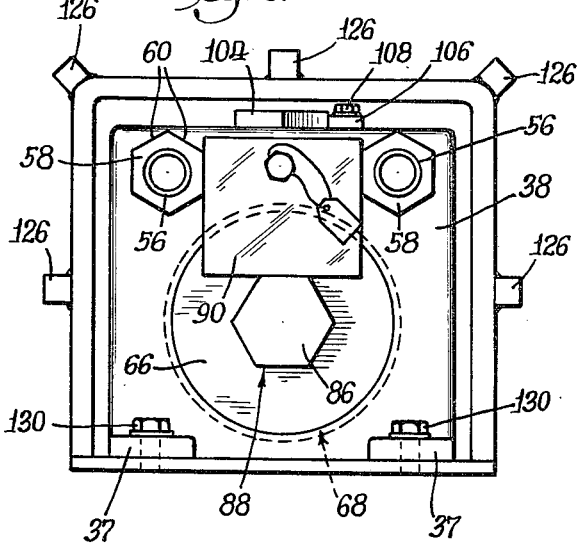
FIGS. 2 and 3 are head and tail end views of the lamp shown in FIG. 1.

The lamp, assembled as shown in FIG. 1, is generally designated 20. It comprises a rectangular bulb housing 22 and a rectangular cage-like outer guard assembly 24, each made of a suitable metal such as aluminum or steel.

The bulb housing has four elongated, rectangular sidewalls 26, 28, 30 and 32. Sidewall 26 is imperforate except for pairs of mounting bolt holes 36 in feet or pads 37 at the opposite ends and serves as a mounting base. In the embodiment illustrated, a window 34 is set by adhesive in each of the other three sidewalls. The window material is impact-resistant, high temperature glass or the like and is preferably in the neighborhood of $\frac{5}{8}$ inch thick to provide adequate strength in underground mining service.

Head and tail endwalls 38 and 40 respectively, substantially square in the embodiment illustrated, join the four sidewalls at the opposite ends. They provide a closed, electrically-sealed housing to prevent ignition of any possible explosive external atmosphere. The bulb housing is illustrated as a unitary casting but could be fabricated of two or more sections welded together.

The head endwall 38 is provided with gland means generally indicated 42 through which electrical power cables 48 extend. The gland means is here shown as a pair of individual glands 44, each comprising a screw-threaded opening 46 in the endwall, and packing rings 50 compressed about the corresponding conductor between an inner washer 52 and a screw-threaded bushing 54. A pipe conduit 56, with a flared inner end flange under the bushing may be employed in permanent installations, but may be omitted in temporary or portable applications. The bushing has an external hexagonal flange 58 with the usual wrench-engageable flats 60.

Figure 6:
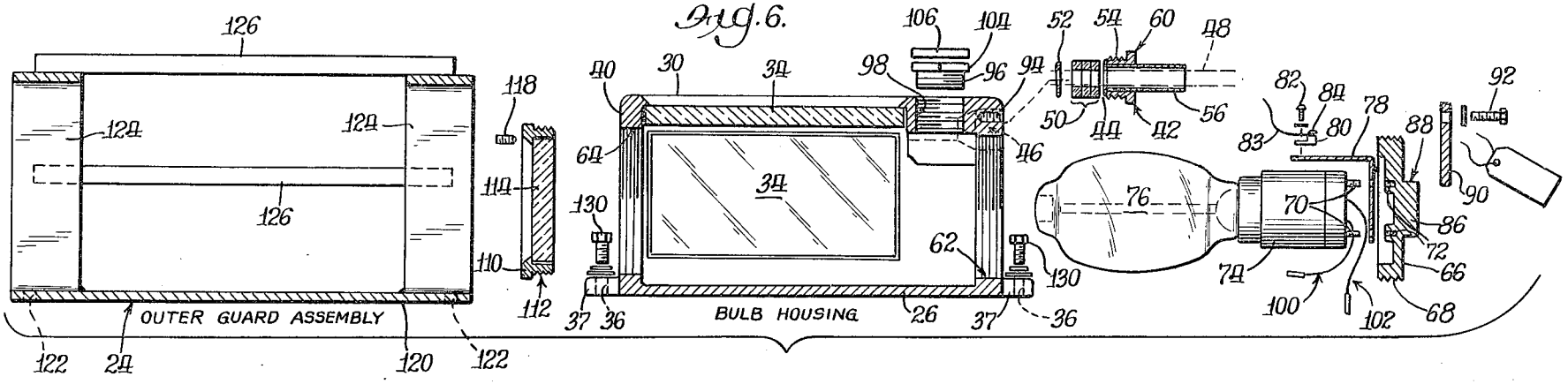
FIG. 6 is an exploded view of the parts comprising the lamp shown in FIG. 1, with some of the parts shown in longitudinal vertical section.

Screw-threaded openings 62 and 64 are provided in the head and tail endwalls respectively. These two endwall openings preferably have the same diameter and thread pitch and, as shown in FIG. 6, are in substantially axial alignment. As will be described, this enables the bulb assembly and head end cover plate, as a unit, to be installed from either end.

A head end cover plate 66 having peripheral threads 68 is engaged within the opening 62. Mounted on the inside surface of the head cover member, by screws 70 in threaded openings 72, is a bulb socket member 74. This places the high intensity discharge bulb 76 in substantially coaxial alignment with the cover plate 66 enabling ready removal of the bulb and cover assembly as a unit by unscrewing it from the opening 62. Because the threads are identical, the bulb and cover assembly may also be removed through the tail end opening 64 if space restrictions at the head end make it more convenient to do so.

An L-shaped grounding strap 78 is interposed between the bulb base and the head cover and held by the usual screws 70 extending from the base. The strap has a forwardly extending leg with a grounding lug 80 fastened by screw 82. A ground wire 83 (extending from conductor cable 48) is fastened to the grounding lug by screw 84.

The outside surface of the head end cover plate 66 has a hexagonal central boss 86 with wrench-engageable flats 88.

A single external locking plate 90, held on the endwall 38 by capscrew 92 in threaded opening 94, has edges engaged simultaneously with flats 60 and 88 on the glands and on the head end cover plate to prevent rotation and loosening of all three threaded members.

A screw-threaded inspection plug 96 is threadedly engageable with a threaded access opening 98 in sidewall 30, near the head end. This access opening provides access to the wiring for the bulb socket member 74 and grounding lug 80. It enables conductors 83, 100 and 102 to be brought outside for connection with the ends of the corresponding leads in the electrical power cable 48. The inspection plug 96 has an external flange with wrench-engaging flats 104. A locking plate 106 is held by a capscrew 108 in a tapped opening in the housing sidewall 30.

The locking plate 106 engages one of the flats 104 on the inspection plug 96, preventing it from rotating and loosening.

The grounding lug 80 is disposed relative to the flats 88 on the external boss 86 so as to align the lug with the access opening 98. This facilitates ready connection or disconnection of grounding conductor 83 with the grounding strap 78.

Figure 3:
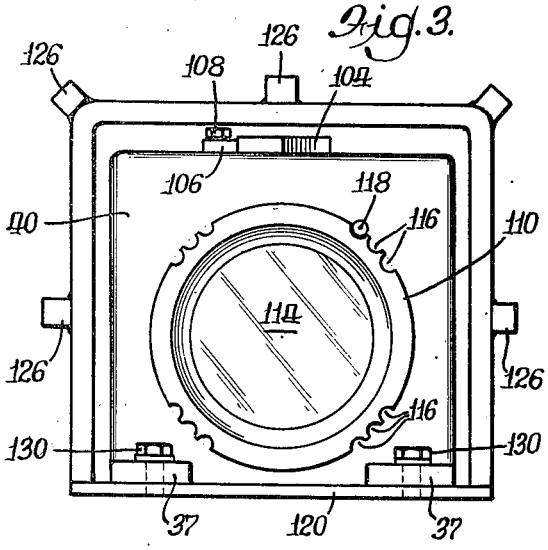
Figure 4:
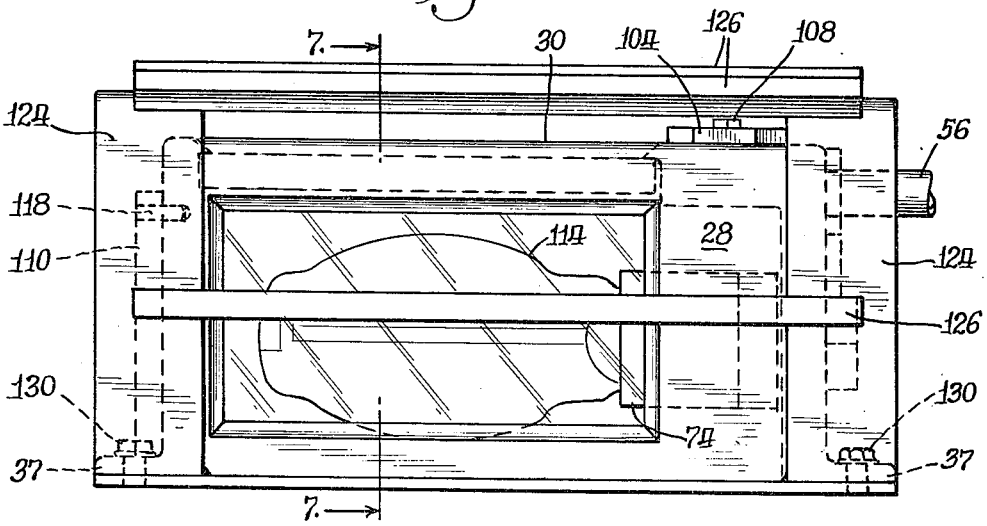
FIGS. 4 and 5 are side and top views of FIG. 1.

A tail cover member 110 has peripheral threads 112 threadedly engaged with the opening 64. It has a window 114 made of glass or like transparent or translucent material. It is held in place by adhesive and may be frosted to reduce glare from the tail end of the bulb 76. As shown in FIG. 3, cover member 110 has a number of peripheral grooves or notches 116, one of which engages a set screw 118 tapped into the tail endwall 40 to prevent rotating and loosening.

The outer guard assembly 24 comprises an elongated support plate or base 120 with pairs of bolt holes 122 at the ends. A pair of inverted U-shaped hoops 124 are fastened as by welding at the ends of the plate 120. A number of longitudinal bars 126 are fastened, as by welding, between the hoops, thereby providing a cage-like protection for the bulb housing 22.

Figure 7:
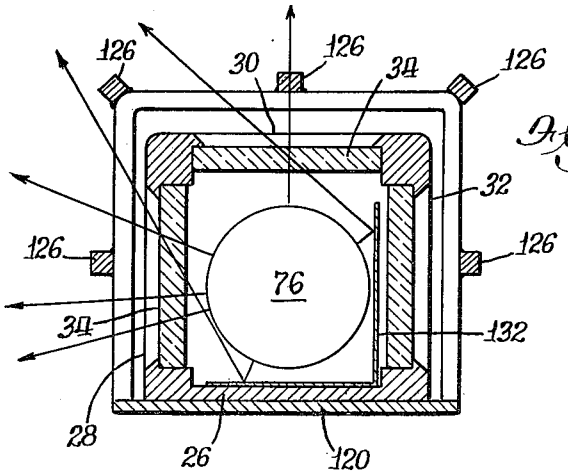
FIGS. 7 and 8 are vertical, transverse, cross-sectional views through the lamp, taken on lines 7—7 of FIGS. 4 and 5, showing use of optional reflectors.

Capscrews 130, extending through the mounting bolt holes 36 in feet 37, are screw-threaded into tapped bolt holes 122 to hold the bulb housing 22 within the outer guard assembly 24. The capscrews 130 may extend through the supporting plate 120 and may be fastened to a wall plate or other suitable base for a permanent installation in a mine. Reflector means may be provided between the bulb 76 and the sidewalls to concentrate and direct light selectively through one or more of the windows 34. For example, as shown in FIG. 7, an L-cross-section reflector 132 may be positioned to direct light through windows in sidewalls 28 and 30. By rotating the reflector 90° clockwise from the FIG. 7 position, the light may be directed through the windows in the sidewalls 30 and 32.

Figure 8:
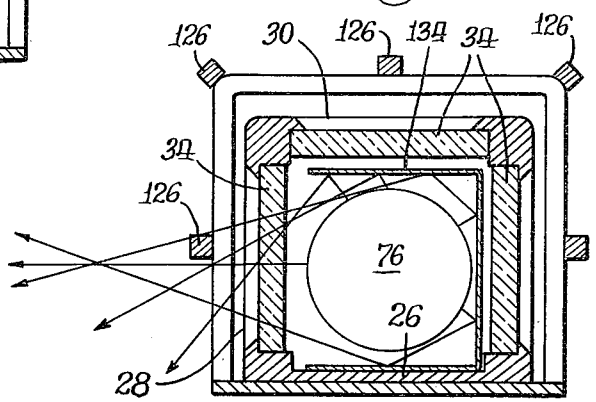
Figure 5:
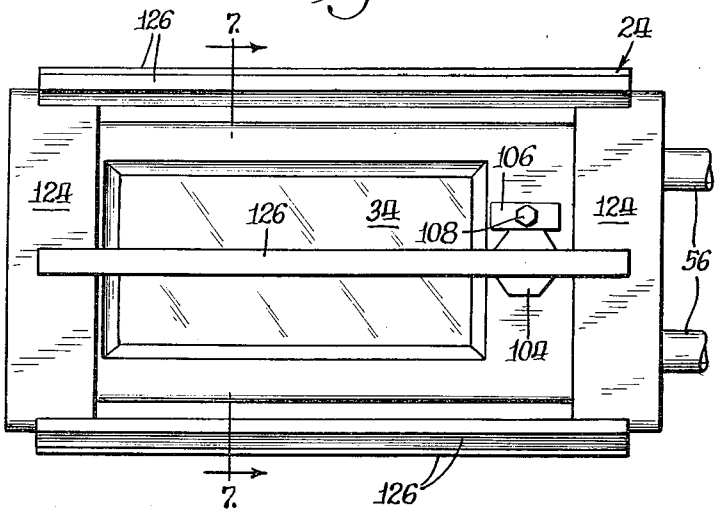

FIG. 8 shows a U-shaped reflector 134 which directs light through the single window in sidewall 28. Alternatively, this may be rotated 90° or 180° to direct light selectively through the window in sidewalls 30 or 32.

In operation, the lamp may be assembled quickly by screwing the bulb and head end cover assembly into the head end opening 62, stopping the ground lug 80 in position to be accessible through the access opening 98, then connecting conductors 83, 100 and 102 to the appropriate leads in the cable 48, bringing their ends outside for that purpose. Then, by locking the head end cover plate 66 and inspection plug 96 in place by means of locking plates 90 and 106, the lamp is immediately ready for use.

The bulb 76, alone, can be changed quickly through the tail end opening 64 simply by removing the locking set screw 118, unscrewing the tail cover member 110, replacing the bulb, screwing the tail end cover back in place and replacing the locking set screw. In an actual test, it was found that the entire operation for replacing the bulb through opening 64 took less than one minute.

Both glands 44 may be utilized where a number of lamps are to be interconnected. Optionally, only one gland may be used in which case the other may be sealed off with a plug (not shown) having a hexagonal flange held locked by locking plate 90.

It will be apparent that the embodiment of the invention illustrated in the drawings is shown merely by way of example and that various modifications can be made within the scope of the invention as defined in the appended claims.

The embodiments of the invention in which an exclusive property or privilege is claimed are defined as follows:

1. A high intensity discharge lamp permissible for use in explosive atmospheres such as mines comprising:

a rectangular bulb housing and a cage-like outer guard assembly therefor;

said bulb housing having four sidewalls extending between head and tail endwalls;

one of said sidewalls being substantially imperforate to serve as a mounting base, and window means of transparent material in at least some of the other three of said sidewalls;

said head endwall having electrical power conductor means extending therethrough, and gland means including flanged threaded bushing means on the outside of said head endwall, said bushing means having flange means with a plurality of wrench-engageable flats;

screw-threaded head and tail cover members threadedly engageable with opposite, aligned, screw-threaded openings in the head and tail endwalls respectively;

said head cover member having mounted on the inside surface thereof a bulb socket member in substantially coaxial relation therewith, and a grounding lug in eccentric relation therewith, said head cover member having a central boss on the outside thereof with a plurality of wrench-engageable flats;

said head cover member having a first locking plate removably fastened to the outside surface thereof and simultaneously engageable with flats on said boss and on said bushing means to prevent rotation and loosening thereof;

a screw-threaded inspection plug threadedly engageable with a threaded access opening in one of said sidewalls, said access opening positioned to provide access to said bulb socket member and grounding lug within the housing, and a second locking plate removably fastened to the outside of the housing abutting a flat on said inspection plug to prevent rotation and loosening thereof;

said outer guard assembly including an elongated support plate, a pair of hoops fastened to the ends of said support plate, and a plurality of bars fastened to said hoops extending parallel to said support plate; and means for fastening said bulb housing within said outer guard assembly with said one sidewall of said bulb housing supported on said support plate of said outer guard assembly.

2. A high intensity discharge lamp according to claim 1 in which one of the flats of said boss on the head cover member is disposed relative to said grounding lug to align the latter with said access opening when said first locking plate is engaged with said one flat.

3. A high intensity discharge lamp according to claim 1 in which a bulb can be removed from said socket member and replaced through the screw-threaded opening in said tail endwall.

4. A high intensity discharge lamp according to claim 1 in which said head cover member, said socket member, and said bulb are removable as a unit through said screw-threaded opening in said head endwall.

5. A high intensity discharge lamp according to claim 1 in which said screw-threaded openings in the head and tail endwalls are the same size and have the same threads enabling either cover member to be installed or removed through either of said screw-threaded openings.

6. A high intensity discharge lamp according to claim 1 including a reflector positioned between the bulb and the enclosure for reflecting light through selected window means in one or more of said sidewalls.

7. A high intensity discharge lamp according to claim 6 in which said reflector is U-shaped in cross-section to reflect light through window means in a selected one of said sidewalls.

8. A high intensity discharge lamp according to claim 6 in which said reflector is L-shaped in cross-section to reflect light through window means in a selected two of said sidewalls.

* * * * *

UNITED STATES PATENT OFFICE

CERTIFICATE OF CORRECTION

PATENT NO. : 4,069,415

DATED : January 17, 1978

INVENTOR(S) : Perfecto Dacal

It is certified that error appears in the above-identified patent and that said Letters Patent are hereby corrected as shown below:

Col. 3; line 44 - "38" should be -- 30 --

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*